United States Patent [19]

Tai

[11] 4,447,349

[45] May 8, 1984

[54] SUDS SUPPRESSING GRANULES FOR USE IN DETERGENT COMPOSITIONS

[75] Inventor: Louis H. T. Tai, Santes, France

[73] Assignee: Lever Brothers Company, New York, N.Y.

[21] Appl. No.: 417,817

[22] Filed: Sep. 13, 1982

Related U.S. Application Data

[63] Continuation of Ser. No. 259,284, Apr. 30, 1981, abandoned.

[30] Foreign Application Priority Data

May 12, 1980 [FR] France ..... 80 10640

[51] Int. Cl.[3] ..... C11D 17/00; B05D 7/00

[52] U.S. Cl. ..... 252/174.13; 252/174.15; 252/90; 427/212; 428/407

[58] Field of Search ..... 252/174.12, 174.13, 252/174.15, 174.17, 321, 358, 135, DIG. 12, 90; 264/117; 427/212; 435/187; 428/407

[56] References Cited

U.S. PATENT DOCUMENTS 3,781,228 12/1973 McDonnell et al. ..... 252/89 X
3,933,672 1/1976 Bartolotta et al. ..... 252/174.15 X
4,009,076 2/1977 Green et al. ..... 427/212 X

FOREIGN PATENT DOCUMENTS 2232262 1/1973 Fed. Rep. of Germany .

*Primary Examiner*—Michael R. Lusignan
*Attorney, Agent, or Firm*—Milton L. Honig; James J. Farrell

[57] ABSTRACT

Silicone-containing microgranules are formed by a coating process using a substantially spherical or cylindrical core material such as a sucrose bead, or an enzyme-containing prill or marume. In a preferred process the core is impregnated with an absorbent such as titanium dioxide, the absorbent is impregnated with a mixture of silicone oil and hydrophobic silica and the coated granule is then coated with wax. The granules are used in detergent compositions.

13 Claims, 3 Drawing Figures

OVERFOAM AREA
40
FOAM HEIGHT (cms)
POWDER A
POWDER B
• FRESHLY PREPARED
○ STORED 37°/70 RH
△ STORED 22°/90 RH
20
30
40
50
60
°C
TEMPERATURE OVERFOAM AREA
FOAM HEIGHT (cms)
40
30
20
10
POWDER E
POWDER F
• FRESHLY PREPARED
○ 37°c / 70% RH
△ 22°c / 90% RH
□ AMBIENT TEMP = RH
60
70
80
90
TEMPERATURE

SUDS SUPPRESSING GRANULES FOR USE IN DETERGENT COMPOSITIONS

This is a continuation of application Ser. No. 259,284, filed Apr. 30, 1981, now abandoned.

This invention relates to suds-suppressing granules and to compositions containing them.

Nowadays, every major manufacturer of detergents includes in his range of products a fabric washing powder formulated for use in front-loading (drum-type) washing machines. Such machines require that the powder should have low sudsing characteristics. There are several ways of producing powders of this type, the most popular being to use soap as a suds-suppressing agent. Soap has some disadvantages however in respect of dispensibility and solubility properties so that manufacturers are beginning to investigate other suds-suppressing agents, among them phosphoric acid esters, complex nitrogen-containing compounds and mixtures of silicone oils with hydrophobic particles.

This invention is concerned with these mixtures of silicone oils with hydrophobic particles, hereinafter referred to as silicone oil mixtures.

It is widely appreciated in the art of detergent formulation that silicone oil mixtures are effective suds-suppressing agents and also that there are problems in incorporating these mixtures into detergent compositions. As described, for instance, in British Patent Specification No. 1,407,997, problems of reduced suds-suppressing activity on storage in detergent powders are encountered unless the silicone oil mixtures are protected in some way from interaction with the remaining components of the formulation. As a consequence it has been proposed to form micro-capsules containing silicone oil mixtures in a protective envelope designed to improve performance after storage. It has also been proposed that solid core particles can be impregnated or coated with silicone oil mixtures and that the resulting granules themselves can be coated with a protective envelope as described above. This approach is described in U.S. Pat. No. 4,013,573.

Despite all these developments, silicone oil mixtures have still not been widely used in commercial detergent products. Part of the difficulty is that when irregularly-shaped substances such as granular sodium tripolyphosphate are used as solid core material for impregnation with silicone oil mixtures, the resultant granule is quickly deactivated on storage.

We have now discovered how to avoid the production of suds-suppressing granules which are quickly deactivated.

According to the broadest aspect of the present invention there are provided suds-suppressing granules for use in detergent formulations comprising a substantially spherical or cylindrical core material and one or more coatings comprising a mixture of silicone oil and hydrophobic particles.

The essential feature of this invention is the use of substantially spherical or cylindrical core material to form the granules. This results in the formation of regular and even layers being built-up when the core material is granulated for instance in an Eirich (registered trade mark) pan granulator or in a Schugi Flexomix (registered trade mark) mixer. This is particularly important when it is intended that the granule should have a final protective envelope, for instance, of paraffin wax, for protecting the silicone oil mixture coating from deactivating agents. The uniformity and integrity of this final envelope coating is an important factor in its effectiveness and we have found that the use of a substantially spherical or cylindrical core improves the qualities of the final coat.

Substantially spherical or cylindrical core materials which we have found satisfactory are beads comprising sucrose, developed particularly for the pharmaceutical industry for the manufacture of pills, spherical enzyme-containing prills and substantially cylindrical enzyme-containing marumes and Alcalase T granules (registered trade mark) manufactured and sold by Novo Industries. The sucrose beads have an average diameter of from 0.1 to 3 mm and are made from a mixture comprising molten sucrose by a spray cooling process. Enzyme-containing prills and marumes are produced by a granulation process and are commercially available from manufacturers of enzymes suitable for detergents use, such as Novo Industries AB.

While granules simply comprising the core material coated with silicone oil mixtures are within the scope of the invention, it is preferred that a more complex granule is produced. The preferred granule has a core coated with particulate absorbent. The absorbent is impregnated with the silicone oil mixture and the resultant particle is coated with a protective envelope. Although starch and titanium dioxide are the materials preferred for use as absorbents other materials can be used. Examples of these are sodium carboxymethyl cellulose, cellulose ethers, finely-divided silica and calcite. Paraffin wax is preferred for use as a protective envelope, particularly a paraffin wax having a melting point in the range 35° to 65° C. Other protectants which can be used are fatty alcohols, ethoxylated fatty alcohols, fatty acids, fatty acid esters and phosphoric acid esters.

In general the various components may be present in the preferred granules in the following amounts:

| | |
|---|---|
| core material | 25–80% |
| absorbent | 15–40% |
| silicone oil mixture | 5–30% |
| protective envelope material | 3–30% |

the percentages being expressed by weight of the total granule.

The following Examples illustrate the use of the invention is detergent compositions and the properties of the granules in comparison with known suds-suppressing materials.

EXAMPLE 1

Two detergent powders having the formulations shown below were prepared by spray-drying and dry-dosing techniques.

| | % by weight | |
|---|---|---|
| | A | B |
| Sodium alkylbenzene sulphonate | 9.0 | 15.0 |
| Nonionic surfactant | 3.0 | 3.0 |
| Sodium tripolyphosphate | 34.0 | 40.0 |
| Sodium silicate | 6.0 | 6.0 |
| Sodium perborate | 24.0 | — |
| Silicone-containing granules | 1.6 | 1.7 |
| Sodium sulphate, Minor components, Moisture | to 100 | to 100 |

In the case of Composition A the silicone-containing granules which were in accordance with the prior art have the composition:

| | % by weight |
|---|---|
| Sodium tripolyphosphate | 75 |
| Silicone mixture | 10 |
| Paraffin wax | 15 |

and in the case of Composition B:

| | % by weight |
|---|---|
| Sucrose beads | 60.2 |
| Silicone mixture | 12 |
| Starch | 24 |
| Paraffin wax | 4.8 |

These granules were made by the general method described below.

Substantially spherical core material in the form of beads of sucrose are granulated in an inclined pan granulator with an absorbent, for example starch, titanium dioxide or a cellulose ether, and a solution/dispersion of a silicone oil mixture in an organic solvent is sprayed onto the particles thereby obtained. The solvent is then evaporated. A protective envelope is then formed over the silicone-impregnated absorbent by spraying a second solution, for example a solution of a paraffin wax in a solvent, preferably one which does not dissolve silicone oil onto the particles. The second solvent is also evaporated.

The suds-suppressing properties of detergent compositions containing the granules of the invention were assessed in a Brandt 432 (registered trade mark) Washing Machine using the 60° and 95° C. cycles. The load was 4 kg of cotton cloth or 2 kg of synthetic cloth and 200 grams of powder was used in each wash cycle.

The height of suds appearing at the port-hole of the washing machine was measured against an arbitrary scale at a series of time intervals during the heat-up period and the temperature of the wash liquor was measured simultaneously.

Normally, three assessments were carried out, the first on powder which was freshly prepared and the second and third on powder which had been stored for one month at 37° C./70% relative humidity and at 22° C./90% relative humidity respectively.

Figure 1:
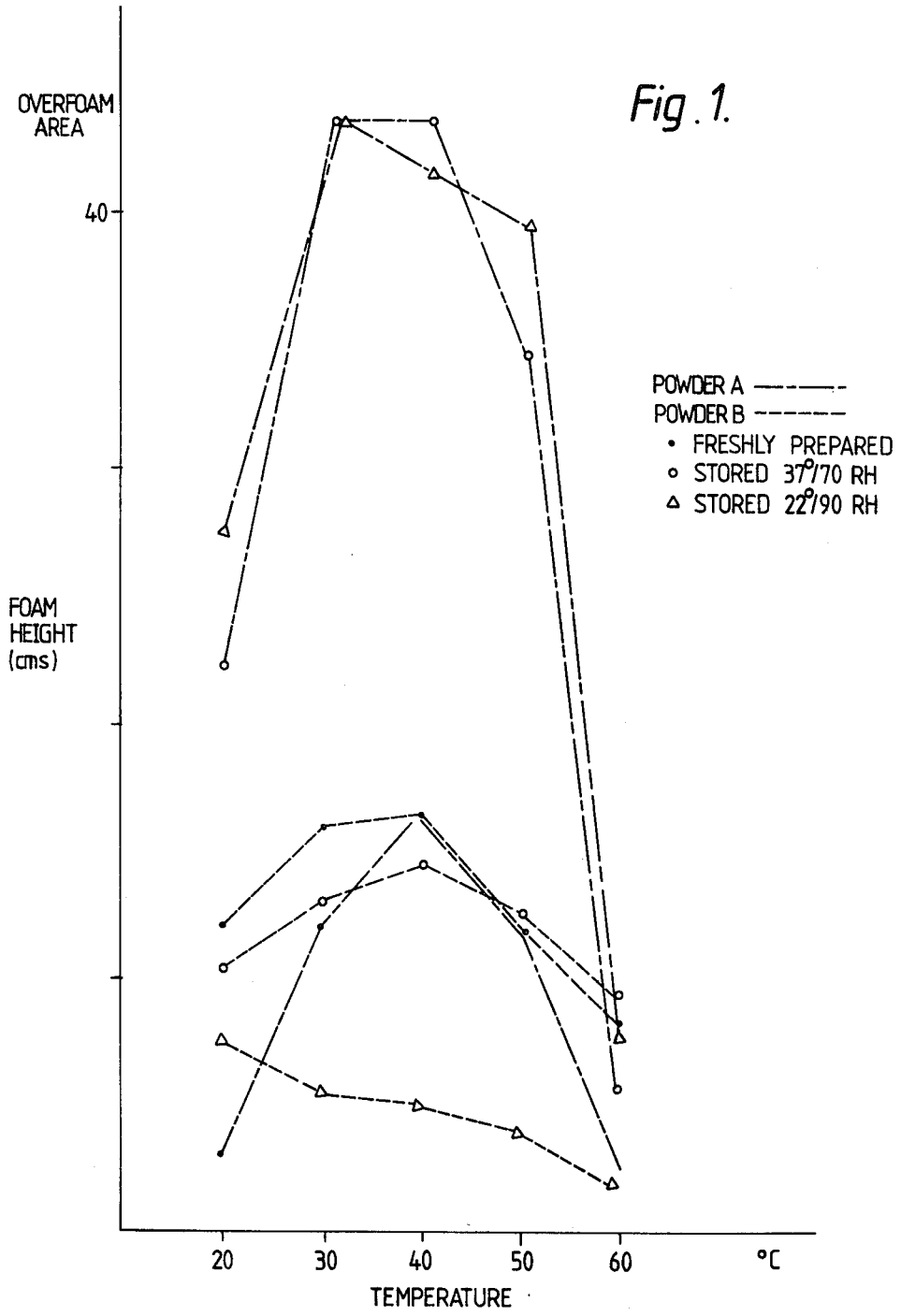
FIG. 1 shows foam results obtained from compositions A and B as outlined in Example 1.

The results for Compositions A and B, using slightly dirty wash goods, are shown in FIG. 1 and demonstrate that although Powder A containing silicone granules formed from an irregularly shaped substrate such as sodium tripolyphosphate produces an acceptable quantity of suds when freshly prepared, the suds-suppressing activity of the granules falls off on storage to such an extent that, when used in a washing machine, overfoaming would be produced. In contrast, Powder B, containing granules formed on substantially spherical beads of sucrose is low sudsing both when freshly prepared and after storage, even though the basic formulation, because of its higher content of alkylbenzene sulphonate, is essentially high foaming.

EXAMPLE 2

Two detergent powders having the formulations shown below were prepared by spray-drying and dry-dosing techniques.

| | % by weight | |
|---|---|---|
| | C | D |
| Sodium alkylbenzene sulphonate | 7.0 | 7.0 |
| Sodium stearate | 4.0 | — |
| Sodium behenate | — | 1.0 |
| Nonionic surfactant | 3.5 | 3.5 |
| Sodium tripolyphosphate | 34.0 | 34.0 |
| Sodium silicate | 6.0 | 6.0 |
| Sodium perborate | 24.0 | 24.0 |
| Silicone-containing granules | — | 0.3 |
| Sodium sulphate, Moisture and minor components | to 100 | to 100 |

The composition of the silicone-containing granules, which were manufactured by the method described in Example 1, was as follows:

| | % by weight |
|---|---|
| Sucrose beads | 55.6 |
| Titanium dioxide | 22.8 |
| Silicone mixture | 10.6 |
| Paraffin wax | 10.6 |
| Silanated titanium dioxide | 0.4 |

The quantity of foam produced by the powders during a washing procedure was assessed as described in Example 1. Although powders which had been stored at 37° L C./70% Relative Humidity and 22° C./90% Relative Humidity were tested in the case of Powder D, there was no substantial difference between the results obtained for freshly prepared or for stored powder. The results obtained using slightly dirty wash goods are shown in FIG. 2.

Figure 2:
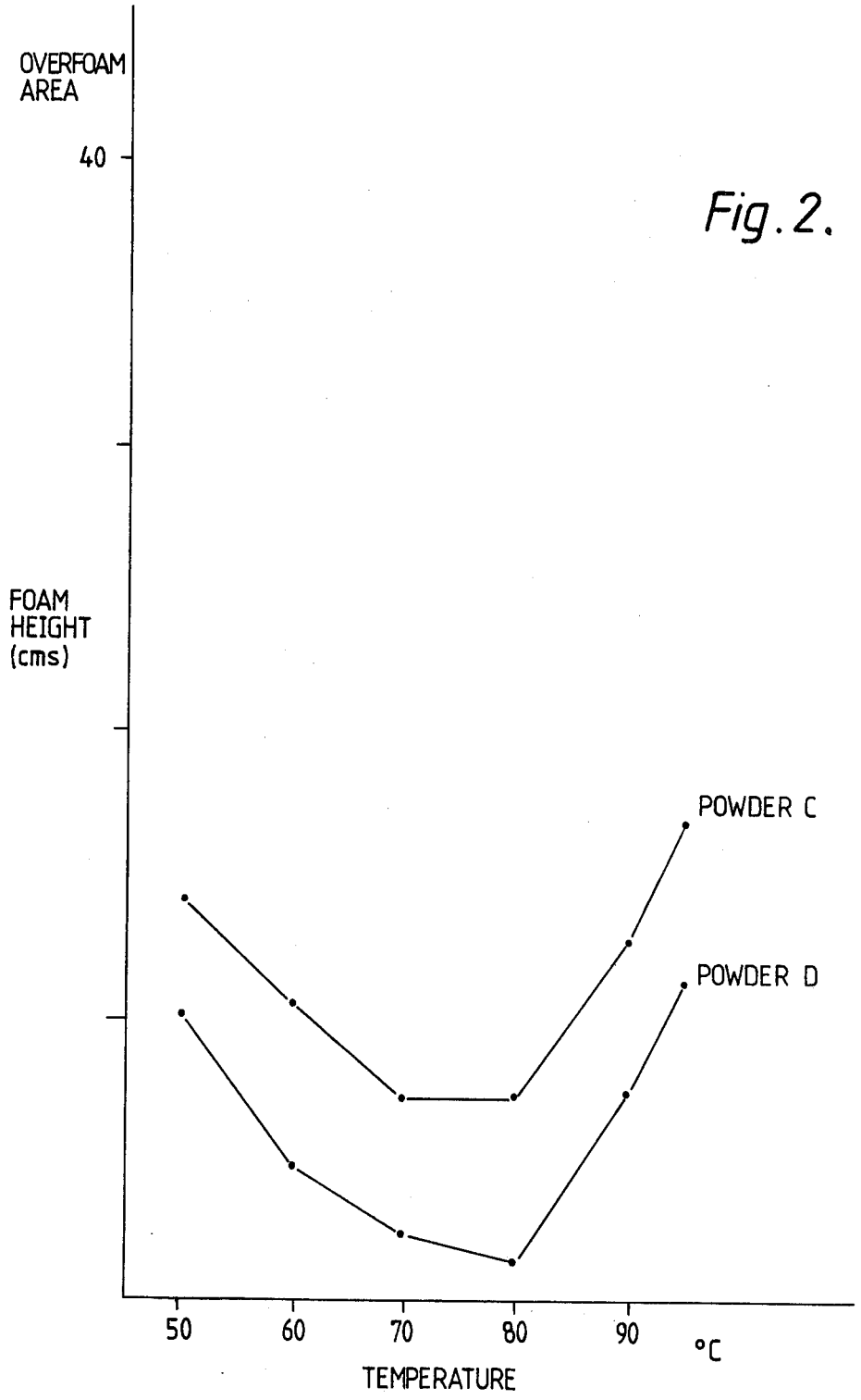
FIG. 2 shows foam results obtained from compositions C and D as outlined in Example 2.

It can be seen from FIG. 2 that in the important high temperature region between 50° and 90° C., Powder D containing 1% of soap and 0.3% of the silicone-containing granules of the invention formed on sucrose beads produces less foam than Powder C formulated with 4% of sodium stearate.

EXAMPLE 3

Two detergent powders having the formulations shown below were prepared as before.

| | % by weight | |
|---|---|---|
| | E | F |
| Sodium alkylbenzene sulphate | 7.0 | 9.0 |
| Sodium stearate | 4.0 | — |
| Nonionic surfactant | 3.5 | 3.0 |
| Sodium tripolyphosphate | 34.0 | 34.0 |
| Sodium perborate | 24.0 | 24.0 |
| Sodium silicate | 6.0 | 6.0 |
| Silicone granules | — | 1.4 |

The composition of the silicone granules was as follows:

| | % by weight |
|---|---|
| Silicone mixture | 10.6 |
| Titanium dioxide | 22.8 |
| Microcrystalline wax 60/63 | 10.6 |
| Enzyme marumes | 55.6 |

Figure 3:
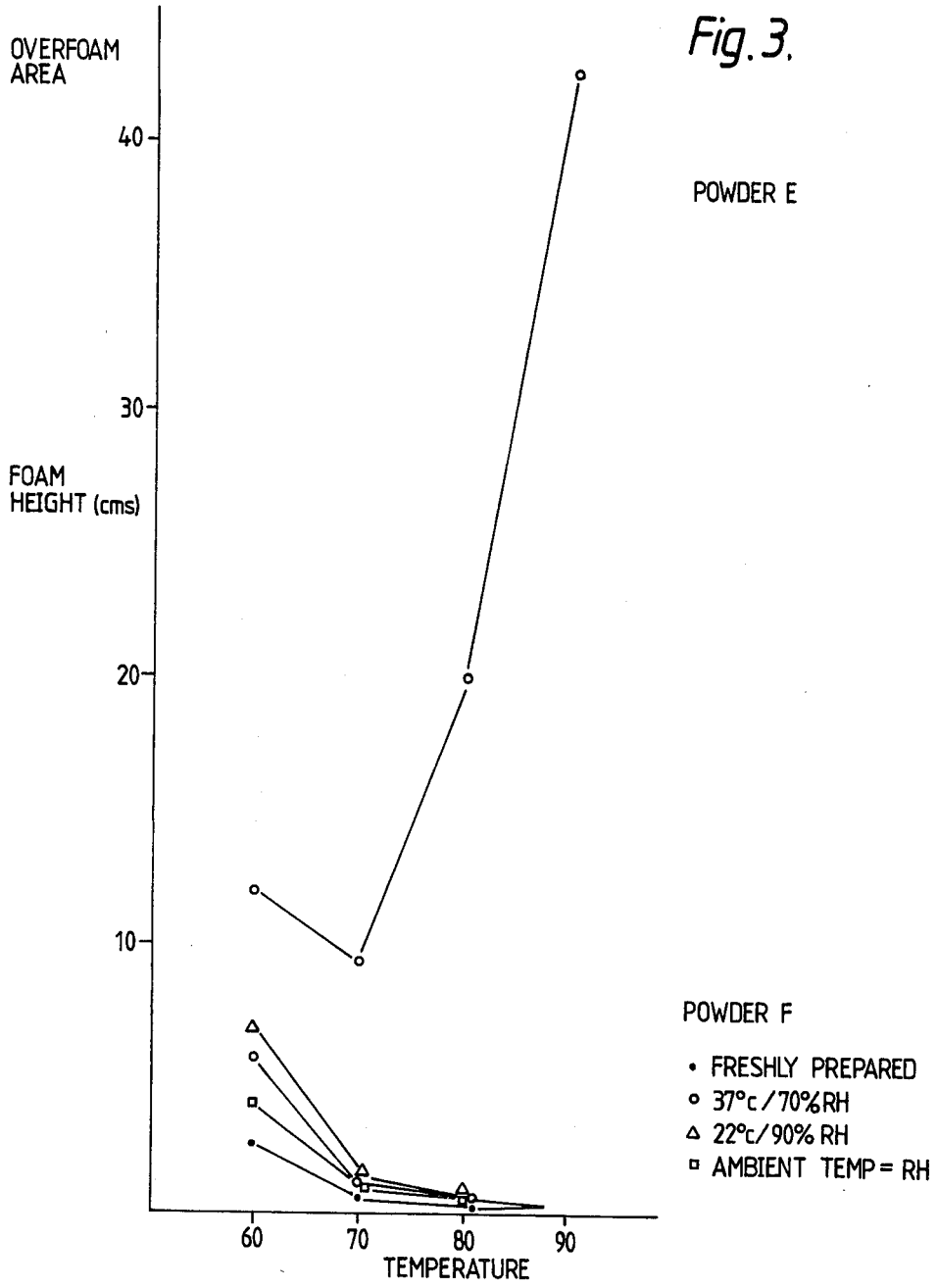
FIG. 3 shows foam results obtained from compositions E and F as outlined in Example 3.

The quantity of suds produced by the powders during a washing procedure was assessed as described in Example 1, both for freshly prepared powder and, in the case of Powder F, for powder which had been stored for one month at ambient temperature and humidity, at 22° C. and 90% relative humidity and at 37° C. and 70% relative humidity. The results obtained using clean wash goods are shown in FIG. 3.

From the Figure, it can be seen that the silicone-containing granules formed on enzyme marumes were substantially more efficient at suppressing suds at a level of 1.4% than was 4% of sodium stearate, despite the fact that Powder F contained higher ratio of anionic to nonionic surfactant and therefore had a higher inherent foaming tendency.

It can also be seen that the deactivation of the granules during storage was relatively minor.

In all the above Examples, the silicone mixture used for preparation of the granules was Silicone DB100 (trade mark) manufactured by Dow Corning, which is a mixture of a polysiloxane and a hydrophobic silica.

The efficiency of the powder containing the granules of the invention in suppressing suds is apparent, particularly at the higher temperature.

It will be understood that this invention is concerned with the suds-suppressing component of a detergent powder and consequently no attempt has been made in this specification to describe all possible powders to which the component could be added. It is self-evident that the usual detergent composition components are appropriate provided that they have no adverse reaction with silicone oil mixtures. For example, anionic surfactants such as alkylbenzene sulphonates, primary and secondary alkyl sulphates, secondary alkane sulphonates, soaps and olefine sulphonates can be used. Nonionic surfactants, either alone or in combination with anionic surfactants can also be used, the preferred nonionic surfactants being $C_7$ to $C_{24}$ primary or secondary alcohols ethoxylated with from 1 to 25 moles of ethylene oxide per mole of alcohol. Typical amounts of surfactant are from 3 to 25% by weight when only one species is present, and from 1 to 12% by weight when more than one is present.

Builders may be present in amounts of from 5 to 50% by weight. Typical of the inorganic builders are sodium tripolyphosphate, sodium pyrophosphate and sodium orthophosphate, sodium carbonate and the crystalline and amorphous forms of aluminosilicates. Organic builders such as sodium nitrilotriacetate, sodium citrate, sodium carboxymethyloxysuccinate, and the host of other materials which have been suggested as phosphate replacers are also appropriate.

Other components which may be present are sodium silicate as a corrosion inhibitor and powder structural oxygen bleaches such as sodium perborate and sodium percarbonate, fluorescers, antiredeposition agents and anti-ashing agents, suds-suppressing agents other than the silicone granules of the invention, and moisture.

What is claimed is:

1. Suds-suppressing granules suitable for use in detergent compositions comprising from about 25% to 80% by weight of a substantially spherical or cylindrical core material of sucrose and one or more coatings, at least one coating comprising from about 5% to 30% based on the weight of the granules of a silicone oil mixture.

2. Granules according to claim 1, wherein one of the coatings comprises from about 15% to 40% by weight of the granules of an absorbent impregnated with the silicone oil mixture.

3. Granules according to claim 2, wherein the absorbent comprises titanium dioxide.

4. Granules according to claim 1 comprising an outer coating of wax.

5. Granules according to claim 3, wherein the wax is a paraffin wax having a melting point of from 35° to 65° C.

6. Granules according to claim 1, wherein the core material is substantially spherical and has an average diameter of from 0.1 to 3 millimeters.

7. Granules according to claim 1, 2, 3, 4, or 5, wherein the core material is formed from molten sucrose by a spray-cooling process.

8. A detergent composition comprising a detergent active compound and granules according to claim 1.

9. A detergent composition according to claim 8, comprising the granules in an amount of from 0.3 to 5% by weight.

10. A process for the manufacture of granules in accordance with any one of claims 1 to 6 which comprises the steps of (i) granulating substantially spherical core material with a particulate absorbent to form a coating of the absorbent on the surface of the cores; and (ii) impregnating the absorbent with a silicone oil.

11. A process in accordance with claim 10, wherein the granulation step is carried out in an inclined pan granulator.

12. A process in accordance with claim 10, wherein the silicone oil is dissolved in an organic solvent and the resulting solution is sprayed onto the absorbent.

13. A process according to claim 10 for the manufacture of granules in accordance with claim 4, wherein as a final step a solution of wax in an organic solvent is sprayed onto silicone-impregnated cores, and the solvent is evaporated.

* * * * *